US006234616B1

(12) United States Patent
Komuro et al.

(10) Patent No.: US 6,234,616 B1
(45) Date of Patent: May 22, 2001

(54) MECHANISM FOR OPENING OR CLOSING INK SUPPLY PASSAGE IN INK-JET PRINTER

(75) Inventors: Kiyoto Komuro; Kazuhiko Hara, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/359,716

(22) Filed: Jul. 23, 1999

Related U.S. Application Data

(63) Continuation-in-part of application No. 09/098,982, filed on Jun. 17, 1998, now abandoned.

(30) Foreign Application Priority Data

Jun. 17, 1997 (JP) ..... 9-176447
Jun. 1, 1998 (JP) ..... 10-150845

(51) Int. Cl.[7] ..... B41J 2/175
(52) U.S. Cl. ..... 347/85
(58) Field of Search ..... 347/30, 84, 85, 347/87, 104

(56) References Cited

U.S. PATENT DOCUMENTS

| | | | | |
|---|---|---|---|---|
| 4,661,822 | | 4/1987 | Hiroto et al. | 347/6 |
| 4,914,453 | * | 4/1990 | Kanayama et al. | 347/86 |
| 5,367,328 | * | 11/1994 | Erickson | 347/7 |
| 5,699,092 | | 12/1997 | Kawakami et al. | 347/30 |
| 5,969,737 | * | 10/1999 | Koyama et al. | 347/86 |

FOREIGN PATENT DOCUMENTS

| | | | |
|---|---|---|---|
| 0 116 893 | 8/1984 | (EP) | B41F/31/28 |
| 0 540 344 | 5/1993 | (EP) | B41J/2/165 |
| 0 778 140 | 6/1997 | (EP) | B41J/2/165 |

* cited by examiner

*Primary Examiner*—Thinh Nguyen
*Assistant Examiner*—Anh T. N. Vo
(74) *Attorney, Agent, or Firm*—Sughrue, Mion, Zinn, Macpeak & Seas, PLLC

(57) ABSTRACT

A valve opening/closing mechanism operated to open a passage by the rotation in the direction of paper feed of a paper feed motor is provided in a part of the passage from an ink cartridge to a recording head and a problem such as the leakage and mixture of ink caused when a printer is vibrated or tilted is prevented beforehand by opening the passage only in recording.

24 Claims, 5 Drawing Sheets

MECHANISM FOR OPENING OR CLOSING INK SUPPLY PASSAGE IN INK-JET PRINTER

This is a CIP application of U.S. Ser. No. 09/098,982 filed on Jun. 17, 1998 now abandoned.

BACKGROUND OF THE INVENTION

The present invention relates to a mechanism for opening or closing an ink supply passage in an ink-jet printer.

In an ink-jet printer for processing a large quantity of data, particularly in an ink-jet printer for enabling a large quantity of color printing, ink cartridges with large capacity for respectively housing at least four types such as black, cyan, magenta and yellow of ink are provided outside the side frame of the printer main body, however, to further downsize the above printer, these ink cartridges are sometimes arranged symmetrically in a lower part on both sides of the printer main body.

However, as large difference is made between the head of a recording head and the head of each ink cartridge and large difference is made between each head of the right and left ink cartridges when the printer main body is tilted in case the ink cartridges are arranged symmetrically in the lower part on both sides of the printer main body as described above, a problem such as the leakage of ink and the color mixture of ink may be caused in case the printer main body is vibrated or is tilted when it is carried.

SUMMARY OF THE INVENTION

The present invention is made to solve such a problem and the object is to provide a mechanism for opening or closing an ink supply passage in a new printer which can also securely prevent ink from leaking by opening a passage from an ink cartridge to a recording head only in recording in a printer where ink cartridges are arranged symmetrically.

That is, to achieve such an object, the present invention is characterized in that a valve opening/closing mechanism operated to open a passage by the rotation in the direction of paper feed of paper feed roller driving means is provided in a part of the passage from an ink cartridge to a recording head in an ink-jet printer of a type that a cartridge housing for housing an ink cartridge is arranged symmetrically on both sides of the printer main body, ink is prevented from leaking by always closing the passage except in recording and bubbles can be readily exhausted by arranging the valve chamber which is a part of the valve opening/closing mechanism below a position in which the recording head is arranged even if the bubbles enter from an ink cartridge to a valve chamber.

DETAILED DESCRIPTION OF THE PREFERRED EMBODIMENTS

An embodiment of the present invention will be described below.

Any drawing shows the embodiment of the present invention.

Figure 3:
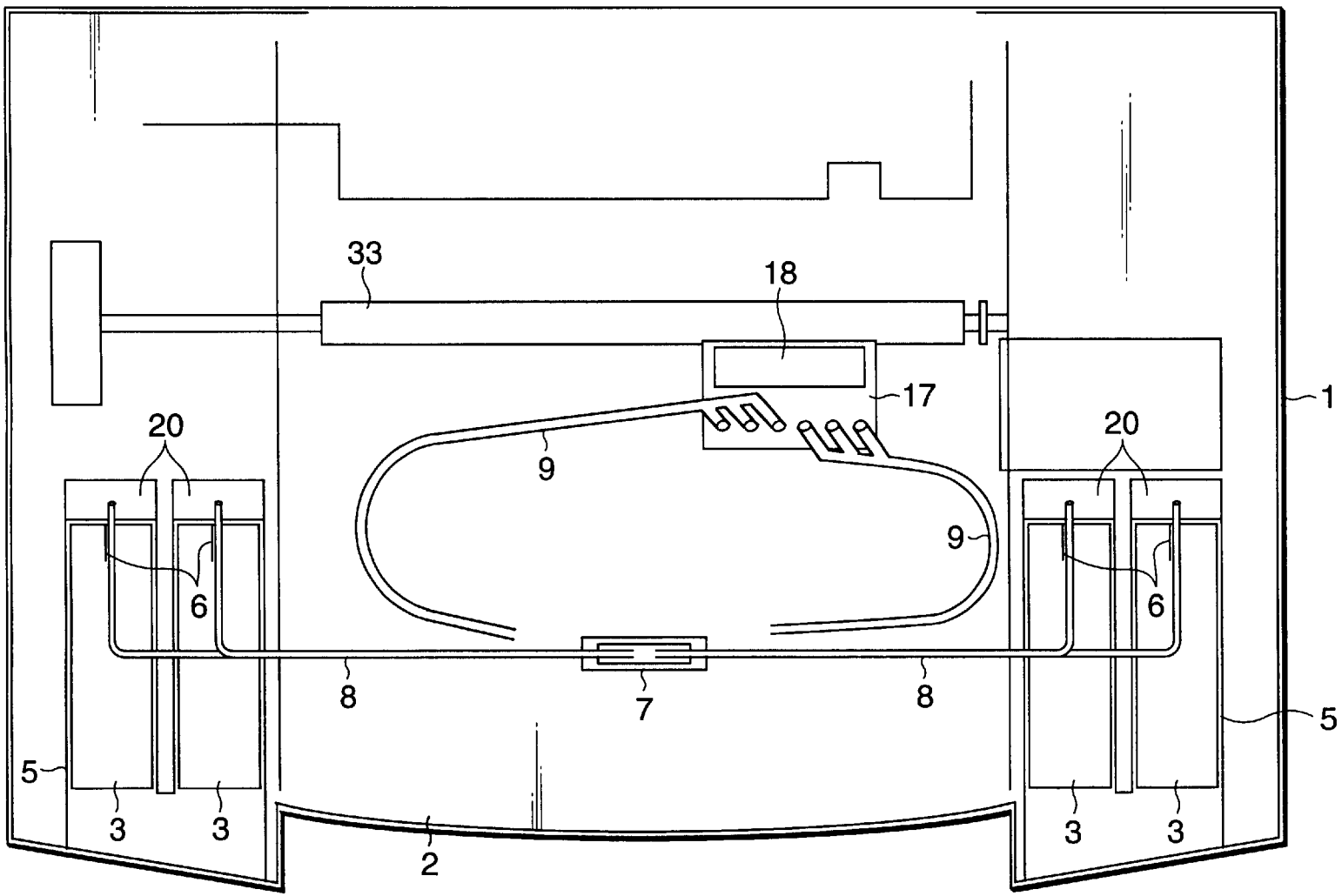
FIG. 3 is a top view showing the main part of a printer provided with the above mechanism.

First, referring to FIGS. 3 and 4, the outline constitution of an ink supply system to which a mechanism according to the present invention is applied in an ink-jet printer will be described.

In a printer main body denoted by a reference number 1, two cartridges housings 5 in each of which ink cartridges 3 for housing each ink of black, cyan, magenta and yellow are installed are provided on both sides of a central paper feed path 2, an ink supply needle 6 communicating with the inside of the ink cartridge 3 by piercing an ink supply port 4 provided on the end face of the ink cartridge 3 is protruded from the inner part of each housing 5, further, an ink supply pipe 8 extended from each ink supply needle 6 to a connection 7 provided above a valve opening/closing mechanism 20 and in the center of the printer main body 1 via the valve opening/closing mechanism 20 described later is provided and a flexible ink tube 9 for supplying ink to each recording head 18 on a carriage 17 is extended from the connection 7.

Figure 1:
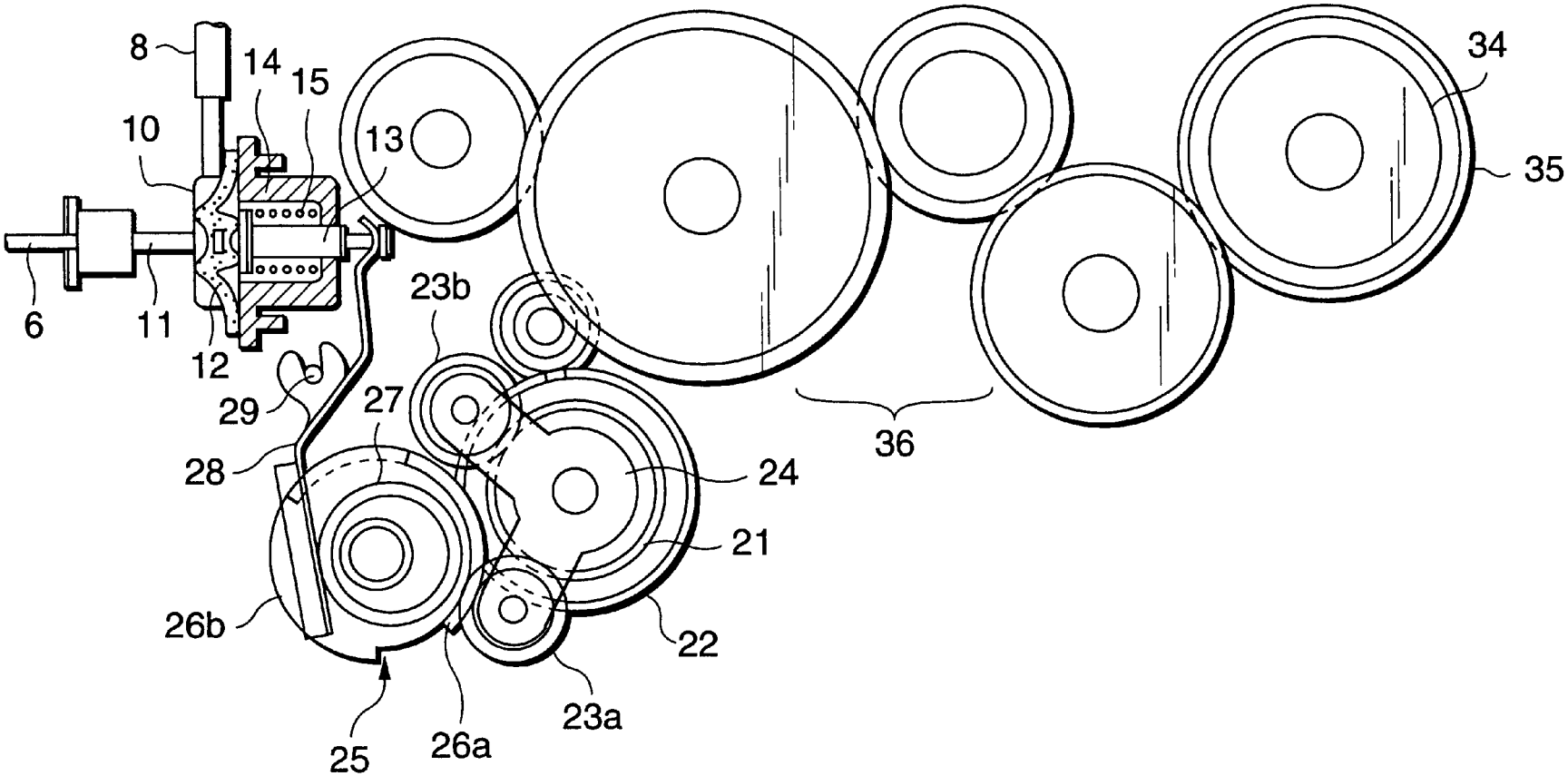
FIG. 1 shows a driving system of an ink supply valve opening/closing mechanism quivalent to an embodiment of the present invention.

Next, referring to FIG. 1, the details of the above valve opening/closing mechanism 20 will be described. A reference number 10 denotes a valve chamber provided to a passage 11 from the ink supply needle 6 to the ink supply pipe 8, the valve chamber 10 is formed in a base 16 for supporting the cartridge housing 5 together with the passage 11 as shown in FIG. 2, in the valve chamber a disc-like valve 12 made of elastic material is arranged so that it closes the passage 11 with the valve always pressed by a compression spring 15 in a valve holder 14 from outside the valve chamber 10, further the other end of a rod 13 integrally protruded from the center of the valve 12 is protruded outside the valve holder 14 and one end of a valve opening/closing lever 28 fluctuating around a supporting point 29 is connected to the other end of the rod.

Figure 4:
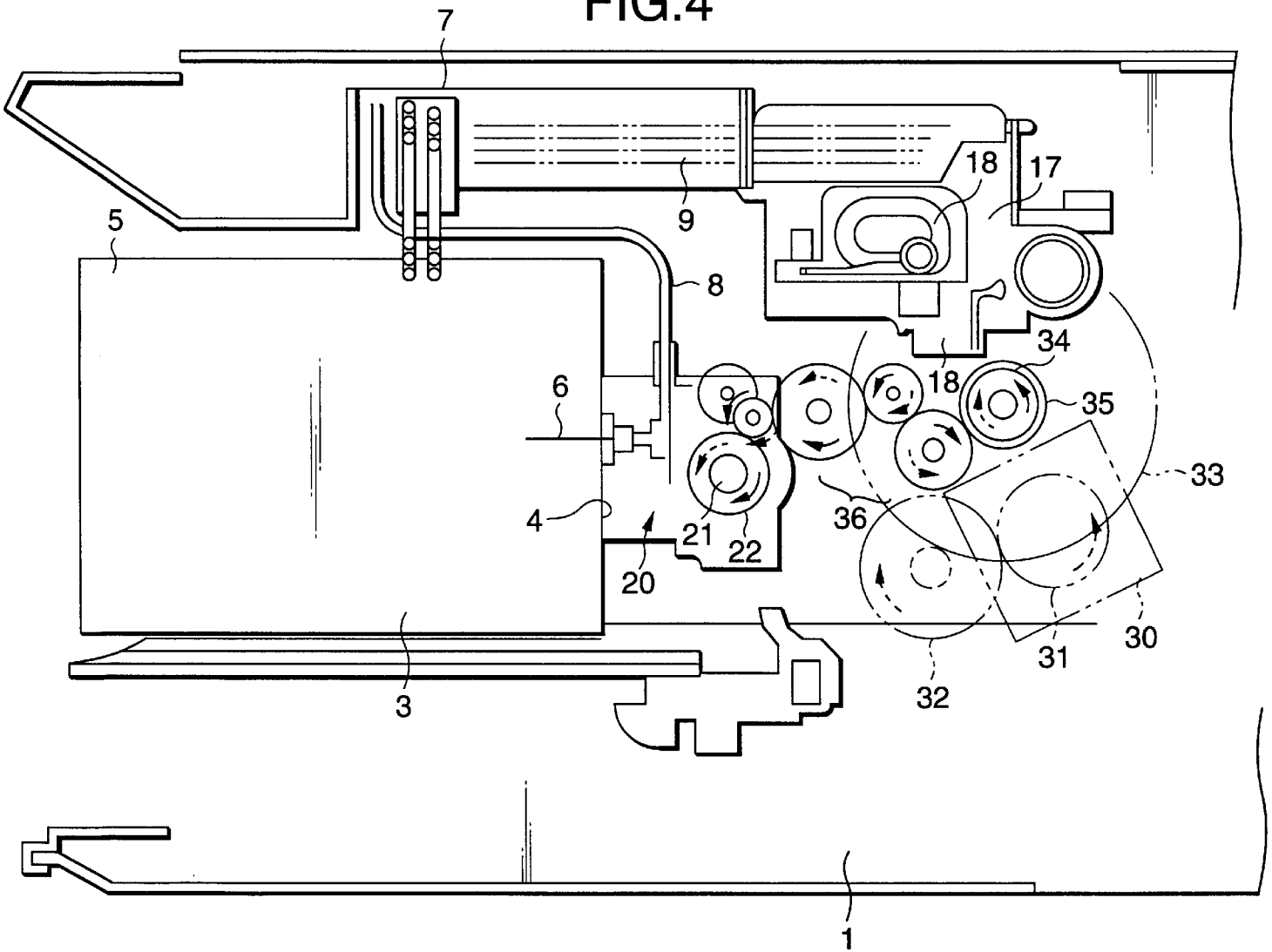
FIG. 4 is a side view showing the printer provided with the above mechanism.

In the meantime, as shown in FIG. 4, a paper feed gear 33 fixed to one end of a paper feed roller 34 via an intermediate gear 32 engaged with its pinion 31 is engaged with a paper feed motor 30 attached to a side frame on one side of the printer main body 1 and further, a sun gear 21 and its integrated pinion 22 respectively constituting the valve opening/closing mechanism 20 are engaged with a roller gear 35 fixed to the other end of the paper feed roller 34 via a series of gears 36.

The sun gear 21 makes a valve opening/closing cam gear 25 described later rotate as predetermined so that the ink supply valve 12 is opened by the rotation in the direction of paper feed of the paper feed motor 30 and is closed by the rotation in the direction reverse to paper feed of the paper feed motor 30 and the above sun gear is constituted so that two planetary gears 23*a* and 23*b* on the contact surface of the sun gear 21 respectively connected to a common lever 24 are respectively revolved in the rotational direction of the sun gear 21 and are engaged with the valve opening/closing cam gear 25.

Figure 5:
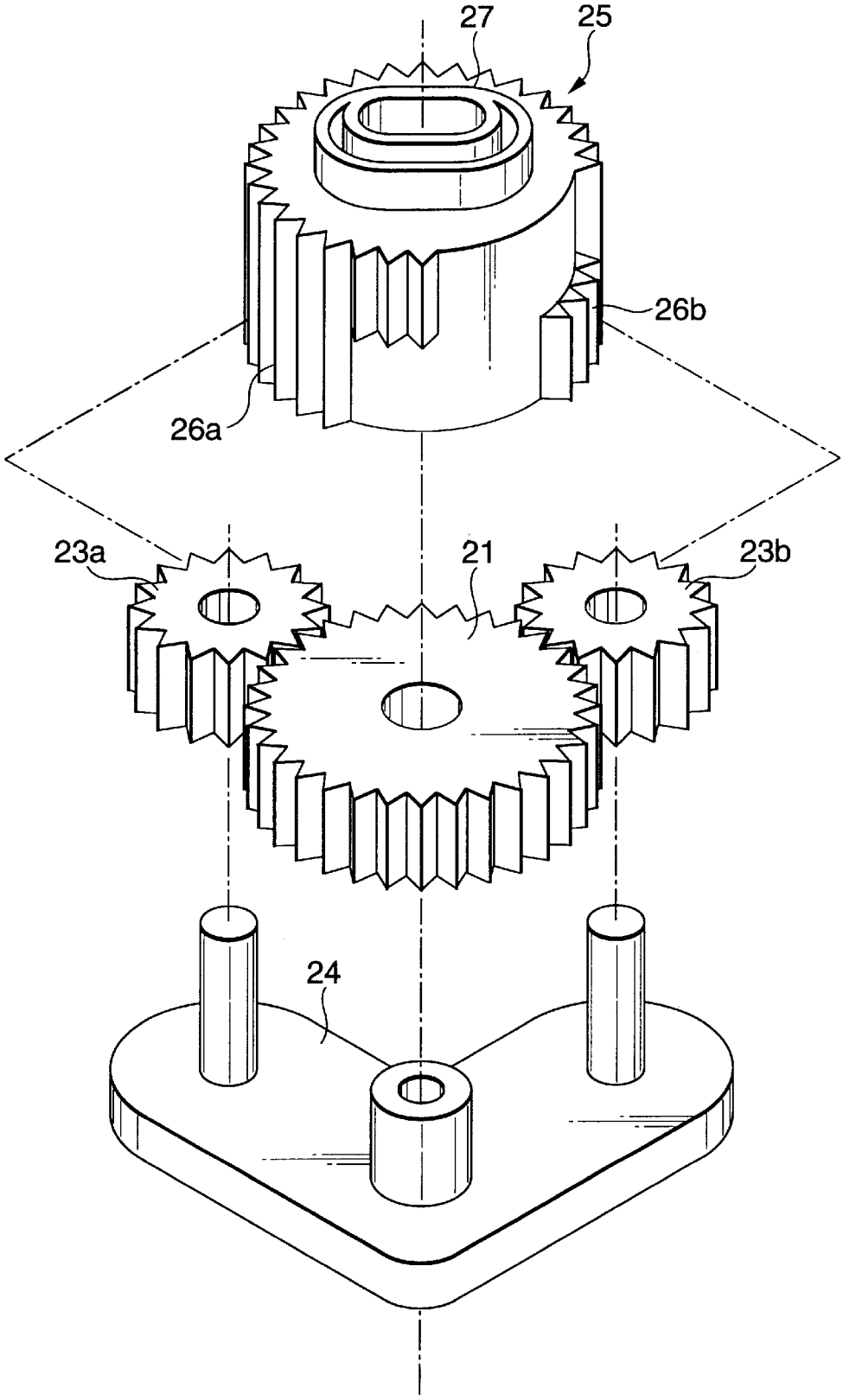
FIG. 5 is a schematic perspective view of the gear mechanism as shown in FIG. 2.

In the meantime, as shown in FIG. 5 two trains of chipped gears 26*a* and 26*b* engaged with either of the two planetary gears 23*a* and 23*b* are placed one upon another in an axial direction with their phases shifted by 90° on the contact surface of the valve opening/closing cam gear 25 engaged with either of the two planetary gears 23*a* and 23*b* and rotated or inverted according to the rotational direction of the sun gear 21 and an eccentric cam 27 for fluctuating the valve opening/closing lever 28 is integrated on one surface of the valve opening/closing cam gear 25.

As in the device constituted as described above, the valve opening/closing mechanism 20 is arranged in the vicinity of the cartridge housing 5 and below the recording head 18, bubbles moved in the recording head 18 together with the flow of ink can be readily exhausted outside by suction in capping operation or flushing operation even if the bubbles in the ink cartridge 3 enter the valve chamber 10 and a failure in jetting ink can be prevented beforehand.

In the meantime, when the paper feed motor 30 is rotated in the direction of paper feed under this state to record on recording paper, the paper feed roller 34 started being rotated in a direction shown by an arrow shown by a full line in FIG. 4 via its pinion 31 and the intermediate gear 32 engaged with the pinion rotates the sun gear 21 in the direction shown by the arrow shown by the full line in FIG. 4 via the series of gears 36 engaged with the roller gear 35 at the other end.

Figure 2A:
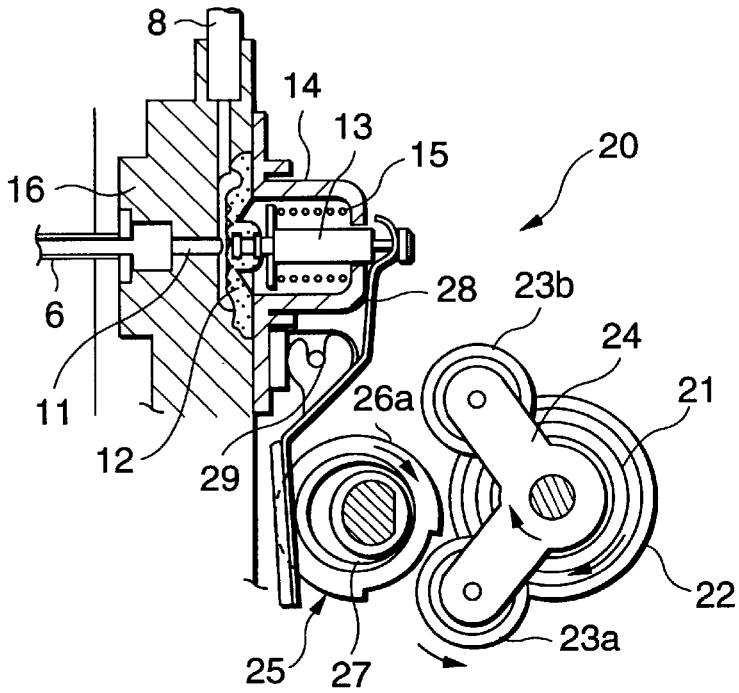
FIGS. 2A and 2B respectively show valve opening operation and valve closing operation by the above mechanism.

Hereby, the sun gear 21 revolves the first planetary gear 23*a* engaged with the sun gear in the rotational direction of the sun gear 21 as shown in FIG. 2A, engages the first planetary gear with one gear 26*a* of the valve opening/closing cam gear 25, rotates the valve opening/closing cam gear 25 to the chipped part in the direction shown by the full line in FIG. 4 and stops it, rotates the valve opening/closing lever 28 clockwise in FIG. 4 by the cam 27 provided on one surface of the valve opening/closing cam gear 25, lifts the valve 12 against the compression spring 15, opens the passage 11 from the ink cartridge 3 to the supply pipe 8 and keeps the supply of ink to the recording head 18 possible.

Figure 2B:
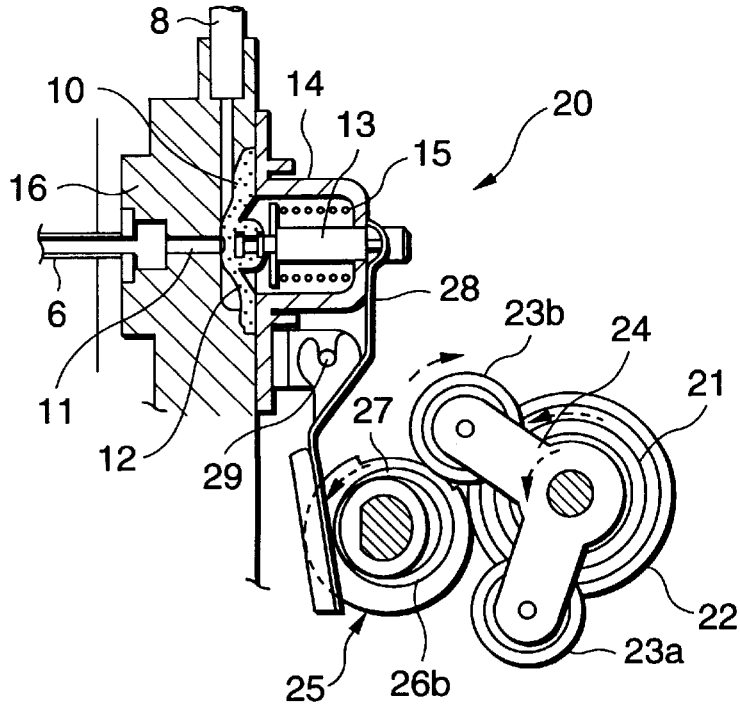

Next, when required recording is finished, the paper feed motor 30 is reversely rotated in the direction reverse to paper feed according to a preset sequence, the sun gear 21 is rotated in a direction shown by an arrow shown by a broken line in FIG. 4 via the roller gear 35 and the series of gears 36, the second planetary gear 23*b* engaged with the sun gear is revolved in the rotational direction of the sun gear 21 as shown in FIG. 2B and is engaged with the other gear 26*b* of the valve opening/closing cam gear 25, the other gear 26*b* is rotated to the chipped part and stopped, pressure upon the valve opening/closing lever 28 is released by the cam 27 integrated with the other gear, the passage 11 is closed by the valve 12 by the pressure of the compression spring 13 while the printer is not used and the leakage of ink from the ink cartridge 3 and the mixture of ink with another ink are prevented beforehand.

As shown in FIGS. 2A, 2B and 4, the ink supply valve 12 is disposed between the ink supply needle 6 and the ink supply pipe 8. The ink supply needle 6 is protruded from the inner part of the ink cartridge housing 5 so as to pierce through the ink supply port 4 provided on the end face of the ink cartridge 3 installed in the cartridge housing 5. One end of the ink supply pipe 8 is connected to the recording head 18 so as to form an ink supply passage.

When an ink jetting face of the recording head 18 is sealed with a suction cap (not shown) and negative pressure is accumulated within the suction cap using ink suction member (not shown) while closing the ink supply valve 12, the level of negative pressure within the suction cap reaches to the maximum of which the ink suction member is able to produce since the ink supply passage is closed.

After that, when the ink supply valve is opened, a high speed discharged ink flow can be produced though nozzles arranged on the ink jetting face. Consequently, persistent bubbles staying within the recording head 18 and remaining bubbles in the upper part of a filter (not shown) installed to prevent extraneous material from entering into the recording head 18, can be exhausted.

Opening the ink supply valve only for color ink with particularly poor recovery enables the fluid flow of discharged ink to increase, so that bubbles and dried ink firmly adhered to the tip of nozzle openings can be exhausted.

Changing flow velocity causes bubbles staying within the ink supply passage to separate from the adhered surface, so that bubbles can be exhausted together with the flow of discharged ink.

As described above, according to the present invention, as the mechanism for opening the passage from the ink cartridge by the rotation in the direction reverse to paper feed of the paper feed motor is arranged in the printer of the type that the ink cartridges are arranged symmetrically on both sides of the main body, the passage from the ink cartridge to the recording head is opened only in recording, utilizing the motor used for paper feed, the leakage of ink and the mixture of ink respectively caused by difference between the head of the recording head and the head of the ink cartridge and difference between each head of the right and left ink cartridges when the printer is tilted can be prevented beforehand.

As a part of the gear provided with the cam for opening or closing the valve is chipped and the gear is driven by the planetary gear mechanism, the valve can be readily kept a closed state or an open state by engaging the planetary gear with the chipped part and this type of mechanism can be greatly simplified.

In addition, even if bubbles enter the valve chamber from the ink cartridge, the bubbles can be readily exhausted by ink suction operation and flushing operation in capping operation because the valve chamber constituting a part of the valve opening/closing mechanism is arranged below a position in which the recording head is arranged, a failure in jetting ink can be prevented beforehand, bubbles in the flexible tube constituting the passage of ink are exhausted in an early stage, the deterioration of ink caused by the mixture of bubbles is prevented, the passage is prevented from being blocked and the reliability of the printer can be further enhanced.

Further, not only this type of passage opening/closing mechanism can be constituted more simply by forming the valve chamber in a part of the base but the valve chamber can be further simplified and bubbles can be further prevented from being left inside respectively by always pressing the valve provided in the valve chamber in a direction in which the valve is closed by the pressing member provided outside the valve chamber.

What is claimed is:

1. An ink-jet printer comprising:

an ink cartridge;

a recording head;

an ink supply passage connecting the ink cartridge to the recording head;

a valve opening/closing mechanism for opening or closing the ink supply passage;

a paper feed driving mechanism provided along a part of the ink supply passage and mechanically linked to the valve opening/closing mechanism, the valve opening/closing mechanism operable to open the ink supply passage as a result of a rotation of the paper feed driving mechanism.

2. The ink-jet printer as set forth in claim 1, wherein the valve opening/closing mechanism comprises a valve, a chipped gear mechanism provided with a cam mechanically connected to the valve for opening or closing the valve, and a planetary gear mechanism meshing with the chipped gear mechanism for rotating the chipped gear mechanism according to the rotation of the paper feed driving mechanism.

3. The ink-jet printer as set forth in claim 2, wherein the chipped gear mechanism comprises two chipped gears, and the planetary gear mechanism comprises two planetary gears for meshing with the two chipped gears, respectively, and wherein one of the planetary gears meshed with the associated chipped gear operates to open the valve and the other of the planetary gears meshed with the associated chipped gear operates to close the valve.

4. The ink-jet printer as set forth in claim 2, further comprising a lever for mechanically connecting the cam to the valve.

5. The inkjet printer as set forth in claim 1, wherein the valve opening/closing mechanism comprises a valve chamber communicating with the ink supply passage, and that is arranged below a position in which the recording head is arranged.

6. The inkjet printer as set forth in claim 1, wherein the opening/closing mechanism comprises a valve chamber communicating with the ink supply passage, and wherein the valve chamber is arranged adjacent a position in which the ink cartridge is installed.

7. The ink-jet printer as set forth in claim 1, wherein the valve opening/closing mechanism comprises a valve chamber communicating with the ink supply passage, and wherein the valve chamber and a section of the ink supply passage communicating with the valve chamber are formed in a part of a base for supporting a cartridge housing that houses the ink cartridge.

8. The inkjet printer as set forth in claim 1, wherein the valve opening/closing mechanism comprises a valve chamber including a valve and a pressing member provided outside of the valve chamber, and wherein the valve closes the ink supply passage when pressed by the pressing member.

9. The ink-jet printer as set forth in claim 1, wherein the valve opening/closing mechanism closes the ink supply passage for a predetermined time period and then opens the passage while applying negative pressure to a cap for capping the recording head.

10. The ink-jet printer as set forth in claim 1, further comprising:

a plurality of ink cartridges;

a plurality of recording heads;

a plurality of ink supply passages respectively connecting associated ones of said ink cartridges and associated ones of said recording heads;

a plurality of valve opening/closing mechanisms for respectively opening/closing the associated ink supply passages; and a selector for arbitrarily selecting at least one of the valve opening/closing mechanisms to open/close at least one of the ink supply passages.

11. The as set forth in claim 1, wherein the ink-jet printer valve opening/closing mechanism intermittently opens and closes the passage while applying negative pressure to a cap for capping the recording head.

12. A valve opening/closing method, comprising the steps of:

providing an ink-jet printer comprising:

an ink cartridge;

a recording head;

a paper feed drive mechanism;

an ink supply passage connecting the ink cartridge to the recording head; and a valve opening/closing mechanism for opening or closing the ink supply passage, said valve opening/closing passage mechanism is operable to open said ink supply passage as a result of a rotation of said paper feed drive mechanism;

closing the ink supply passage;

applying negative pressure to a cap for capping the recording head; and opening the ink supply passage to discharge ink therein after a predetermined time period lapses.

13. The valve opening/closing method as set forth in claim 12, wherein the ink-jet printer further includes:

a plurality of ink cartridges;

a plurality of recording heads a plurality of ink supply passages respectively connecting associated ones of said ink cartridges and associated ones of said recording heads;

a plurality of valve opening/closing mechanisms for respectively opening/closing the associated ink supply passage; the method further comprising the steps of:

selecting arbitarily at least one of the ink supply passages to be opened by the valve opening/closing mechanisms.

14. A valve opening/closing method, comprising the steps of:

providing an ink-jet printer comprising:

an ink cartridge;

a recording head;

a paper feed drive mechanism;

an ink supply passage connecting the ink cartridge to the recording head; and a valve opening/closing mechanism for opening or closing the ink supply passage, said valve opening/closing passage mechanism is operable to open said ink supply passage as a result of a rotation of said paper feed drive mechanism;

applying negative pressure to a cap for capping the recording head; and opening and closing the ink supply passage intermittently.

15. The valve opening/closing method as set forth in claim 14, wherein the ink-jet printer further includes:

a plurality of ink cartridges;

a plurality of recording heads, a plurality of ink supply passages respectively connecting associated ones of said ink cartridges and associated ones of said recording heads;

a plurality of valve opening/closing mechanisms for respectively opening/closing the associated ink supply passage; the method further comprising the steps of:

selecting arbitrarily at least one of the ink supply passages to be opened by the valve opening/closing mechanisms.

16. A valve opening/closing mechanism for opening or closing an ink supply passage in an ink-jet printer, the ink-jet printer having a cartridge housing for housing an ink cartridge, a recording head, and a paper feed driving mechanism; said valve opening/closing mechanism comprising:

a mechanical link mechanism linking said valve opening/closing mechanism to the paper feed driving mechanism, and, wherein:

said valve opening/closing mechanism is provided in a part of said passage from the ink cartridge to the recording head, said valve opening/closing mechanism operable to open said passage as a result of a rotation of the paper feed driving mechanism.

17. The valve opening/closing mechanism for opening or closing an ink supply passage in an inkjet printer according to claim 16, wherein said valve opening/closing mechanism comprises a valve, and a chipped gear mechanism provided with a cam mechanically connected to said valve for opening or closing said valve, and a planetary gear mechanism meshing with said chipped gear mechanism for rotating said chipped gear mechanism according to the rotation of the paper feed driving mechanism.

18. The valve opening/closing mechanism according to claim 17, wherein said chipped gear mechanism comprises two chipped gears, and said planetary gear mechanism comprises two planetary gears for meshing with said two chipped gears, respectively; and wherein one of said planetary gears meshed with its respective chipped gear operates to open said valve and the other of said planetary gears meshed with its respective chipped gear operates to close said valve.

19. The valve opening/closing mechanism according to claim 17, further comprising a lever for mechanically connecting said cam to said valve.

20. The valve opening/closing mechanism for opening or closing an ink supply passage in an ink-jet printer according to claim 16, wherein a valve chamber constituting a part of said valve opening/closing mechanism is arranged below a position in which said recording head is arranged.

21. The valve opening/closing mechanism for opening or closing an ink supply passage in an ink-jet printer according to claim 16, wherein said valve chamber is arranged in the vicinity of a position in which said ink cartridge is installed.

22. The valve opening/closing mechanism for opening or closing an ink supply passage in an ink-jet printer according to claim 16, wherein said valve opening/closing mechanism comprises a valve chamber communicating with the ink passage, and wherein said valve chamber and a part of the ink passage communicating with said valve chamber are formed in a part of a base for supporting said cartridge housing.

23. The valve opening/closing mechanism for opening or closing an ink supply passage in an ink-jet printer according to claim 16, wherein said valve opening/closing mechanism comprises a valve chamber including a valve, and a pressing member provided outside said valve chamber, and wherein said valve closes the supply passage when pressed by said pressing member.

24. An ink-jet printer, comprising:

a cartridge housing for housing an ink cartridge, a recording head, an ink supply passage for connecting the ink cartridge to the recording head, a paper feed driving mechanism, and valve opening/closing means for opening or closing the ink supply passage in response to a rotation of said paper feed driving mechanism, and wherein said valve opening/closing means is provided in a part of said ink supply passage between said ink cartridge and said recording head.

* * * * *